US006161884A

United States Patent [19]

Pearl

[11] Patent Number: 6,161,884

[45] Date of Patent: Dec. 19, 2000

[54] SOURCE-CODED UNITARY EYE BOLTS

[75] Inventor: Fred R. Pearl, Westminster, Calif.

[73] Assignee: Actek Enterprises, Inc., Santa Fe Springs, Calif.

[21] Appl. No.: 09/346,651

[22] Filed: Jul. 1, 1999

Related U.S. Application Data

[60] Provisional application No. 60/091,411, Jul. 1, 1998.

[51] Int. Cl.[7] ..... A47F 13/06

[52] U.S. Cl. ..... 294/1.1; 248/499; 410/101; 411/400

[58] Field of Search ..... 248/500, 505, 248/499; 411/400, 389; 294/1.1; 24/115 K; 403/119, 164, 60; 410/101

[56] References Cited

U.S. PATENT DOCUMENTS

| | | | |
|---|---|---|---|
| 3,297,293 | 1/1967 | Andrews et al. | 248/499 |
| 3,905,633 | 9/1975 | Larson | 248/499 X |
| 4,431,352 | 2/1984 | Andrews | 410/401 |
| 4,705,422 | 11/1987 | Tsui et al. | 403/60 |
| 5,586,801 | 12/1996 | Sawyer et al. | 294/1.1 |
| 5,772,252 | 6/1998 | Malani | 411/389 X |

*Primary Examiner*—Ramon O. Ramirez

*Attorney, Agent, or Firm*—Stout, Uxa, Buyan and Mullins LLP

[57] ABSTRACT

Fastening devices such as swivel hoist rings are provided with machine-readable encoded information permanently affixed thereto.

19 Claims, 2 Drawing Sheets

SOURCE-CODED UNITARY EYE BOLTS

This application claims the benefit of U.S. Provisional Application Ser. No. 60/091,411, filed Jul. 1, 1998 and entitled METHOD OF SOURCE-CODING FOR FAULT-TRACING, the contents of which are expressly incorporated herein by reference.

BACKGROUND OF THE INVENTION

1. Field of the Invention

The present invention relates generally to fastening devices and, more particularly, to a swivel hoist ring and other fastening device, having machine-readable encoded information permanently affixed thereto.

2. Description of Related Art

Various swivel hoist rings have been implemented in the prior art. U.S. Pat. No. 3,297,293 to Andrews et al. discloses a fastening device comprising an eye member which is pivotally and rotationally mounted onto a base. The fastening device, however, comprises a relatively small-diameter retaining ring for contacting the base. Horizontal forces exerted onto the fastening device must thus be absorbed by a stud secured into the base and the relatively small-diameter retaining ring. Additionally, removal of the fastening device from the base can only be achieved by using a tool to grip the head of the stud, which is also configured to have a relatively small diameter. If the head of the stud is damaged, or if a wrench is not available for fitting onto the head of the stud, then the fastening device cannot easily be removed.

Trench plates generally comprise rectangular steel members weighing between 5,000 and 9,000 pounds. A typical trench plate may be 8 feet wide by 12 feet long and 2 inches thick. A threaded nut is secured in a middle area of the trench plate, and is adapted for receiving an eye bolt, according to the prior art. The eye bolt comprises an opening, for receiving a cable or other fastening member. Once the eye bolt is threaded into the nut of the trench plate, and is fastened to a cable, for example, the trench plate can be removed. Eye bolts, however, are incapable of swiveling and maintaining structural integrity under off-axis horizontal loads.

SUMMARY OF THE INVENTION

The trench plate connector of the present invention comprises a large-diameter skirt member for dissipating lateral forces applied onto the trench plate connector. The large-diameter skirt member is threaded onto a stud, and can be locked onto the stud with a nut. Once the large-diameter skirt member is locked into place, one or more arms of the large-diameter skirt member can be used to apply rotational forces onto the trench plate connector to thereby secure or remove the stud of the trench plate connector from the trench plate. Each arm of the large-diameter skirt member can be impacted with a hammer, for example, to apply substantial rotational forces onto the trench plate connector for tightening or removal thereof. A unique double-threaded stud is used to accommodate the large-diameter skirt member of the present invention. The double-threaded stud comprises a first thread on one end for being threaded into a trench plate, and a second thread on the other end for accommodating both the large-diameter skirt member and a securing nut.

The present invention, together with additional features and advantages thereof, may best be understood by reference to the following description taken in connection with the accompanying illustrative drawings.

BRIEF DESCRIPTION THE DRAWINGS

DETAILED DESCRIPTION OF THE PRESENTLY PREFERRED EMBODIMENT

Figure 1:
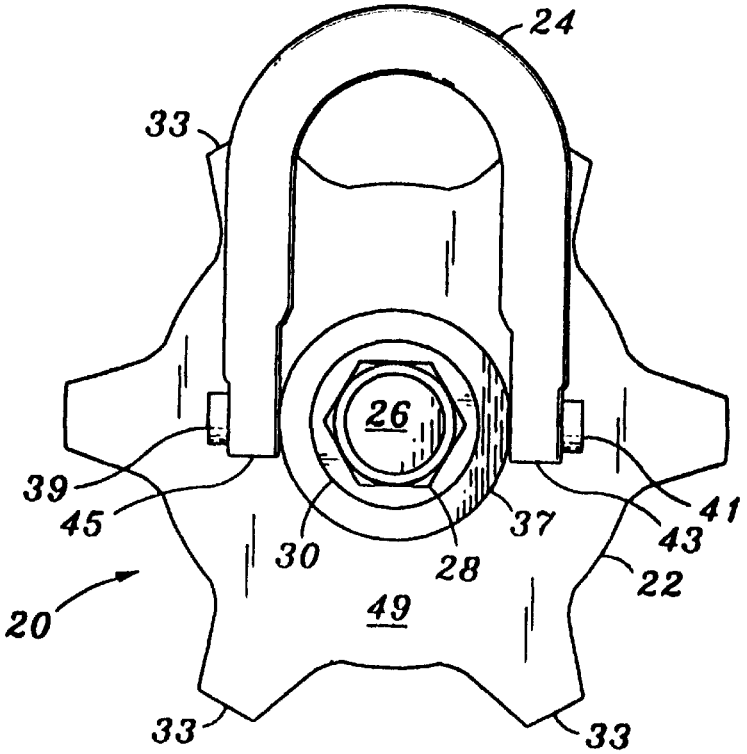
FIG. 1 illustrates a top-planar view of a trench plate connector in accordance with the present invention.

Referring more particularly to the drawings, FIG. 1 illustrates a trench plate connector 20 comprising a large-diameter skirt member 22, an eye member 24, a double-threaded stud 26, a nut 28, and a circular plate 30. The trench plate connector 20 may be machined, as illustrated, or forged. Although the below embodiment illustrates a particular configuration of a machined hoist ring, the present invention is applicable to many other types of fastening devices, such as eye bolts and hoist rings, so long as the fastening device has a threaded bolt for being secured into an object to be lifted. The large-diameter skirt member 22 comprises a number of arms 33 and a threaded aperture 52 (FIG. 3) for accommodating the double-threaded stud 26. The large-diameter skirt member 22 is preferably manufactured to have a diameter of approximately nine inches, and each of the arms 33 is preferably manufactured to have a width at a distal end of approximately one inch.

Figure 2:
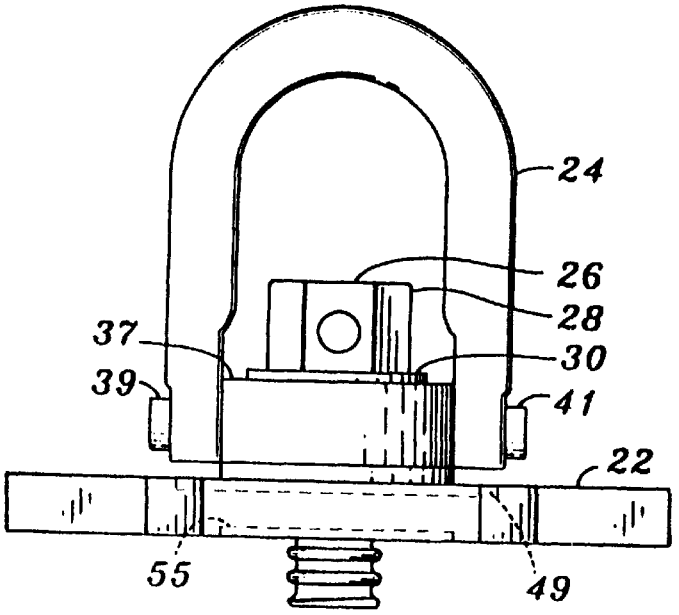
FIG. 2 illustrates a side-elevational view of a trench plate connector in accordance with the present invention.

The eye member 24 is secured to a load ring 37 via two pivot pins 39,41. Each of the two pivot pins 39, 41 passes through an aperture of the eye member 24 and, subsequently, through a corresponding aperture in the load ring 37. (See FIG. 5.) The eye member 24 is shown in FIG. 1 in an off-axis position, relative to an axis of the stud 26. In the configuration of FIG. 1, the eye member 24 is pivoted about an axis formed by the pivot pins 39, 41 in a direction toward the lop of the page. In addition to being pivotable about an axis formed by the pivot pins 39, 41, the eye member 24 is rotatable about an axis of the double-threaded stud 26. FIG. 2 illustrates a side-elevational view of the trench plate connector 20 of the present invention. As can be seen from the phantom line 49, the large-diameter skirt member 22 comprises a recessed area 49. The recessed area 49 provides clearance for the ends 43, 45 of the eye member 24, as the eye member 24 is rotated about the axis of the double-threaded stud 26 in a pivoted position, such as shown in FIG. 1. A clearance between the ends 43,45 of the eye member 24 and the recessed area 49 is greater when the eye member 24 is in a non-pivoted orientation, as illustrated in FIG. 2. As shown in FIG. 2, a thickness of the large-diameter skirt member 22 is preferably ⅝ inch, and a thickness the eye member 24 is preferably one inch. An exterior width of the eye member 24 is preferably 4.8 inches, and an interior width of the eye member 24 is preferably 2.8 inches. A height of the eye member 24 is preferably 7.5 inches, and a height of the eye member and the large-diameter skirt member together is approximately 6.96 inches. The components shown in FIG. 2 preferably comprise 4140 aircraft quality, heat-treated steel, with a finish comprising oil black oxide. The trench plate connector preferably comprises a safety factor of 5 to 1, and a rated load of approximately 10,000 pounds.

Figure 3:
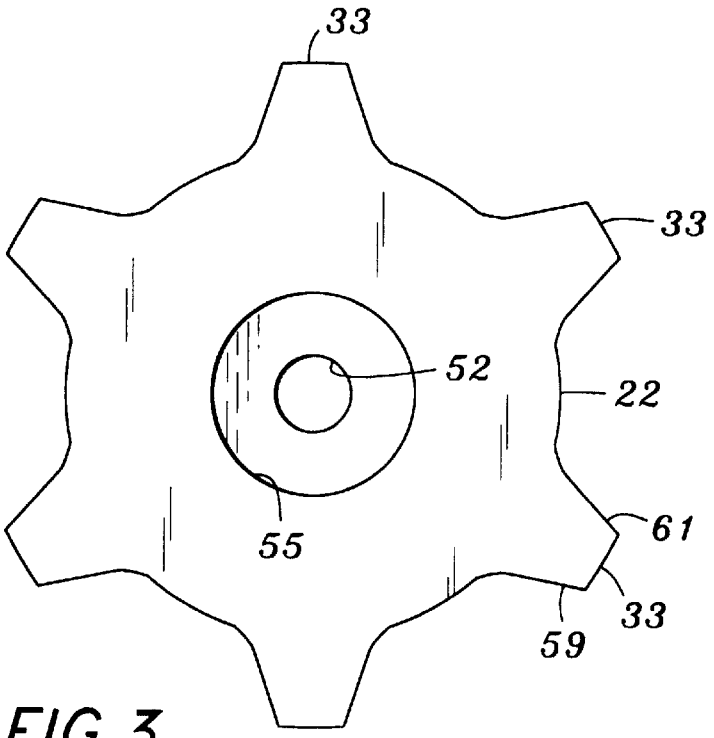
FIG. 3 illustrates a bottom view of a large-diameter skirt member in accordance with the invention.

FIG. 3 illustrates a bottom view of the large-diameter skirt member 22. The large-diameter skirt member 22 comprises a threaded aperture 52 for accommodating the double-threaded stud 26. A second recessed area 55 is formed in the bottom of the large-diameter skirt member 22. The second recessed area 55 is adapted to accommodate a portion of a nut of a trench plate, which may protrude slightly from a surface of the trench plate. The second recessed area 55 helps to ensure that the entire bottom surface of the large-diameter skirt member 22, with possibly the exception of the second recessed area 55, contacts the surface of the trench plate. When the bottom surface of the large-diameter skirt member 22 fits flush against the upper surface of a trench plate, horizontal forces exerted on the eye member 24 and transferred to the double-threaded stud 26, are subsequently transferred from the bottom surface of the large-diameter skirt member 22 onto the upper surface of the trench plate. All of the forces are therefore not concentrated only on the stud 26. Horizontal forces are defined herein as forces which are off-axis to the axis of the double-threaded stud 26.

Another aspect of the present invention is the configuration of the arms 33 of the large-diameter skirt member 22. Each arm 33 comprises two surfaces 59, 61, which are angled approximately radially outwardly from a center of the large-diameter skirt member 22. Each of the surfaces 59,61 is adapted for receiving a rotational force for either threading the double-threaded stud 26 into a threaded nut of the trench plate or unthreading the double-threaded stud 26 therefrom. A hammer, for example, may be applied onto the surface 61 in order to apply rotational forces thereto. In an alternative embodiment, the arms 33 may be extended radially outwardly in order to accommodate rectangular cross-sectioned pipes, for example.

Figure 4:
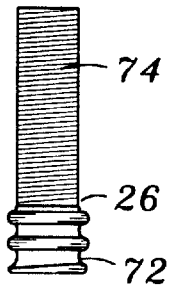
FIG. 4 illustrates a side-elevational view of a double-threaded stud in accordance with the present invention.

FIG. 4 illustrates a side-elevational view of the double-treaded stud 26. The double-threaded stud 26 comprises a first portion of threads 72, which are preferably adapted for being threaded into an aperture of the trench plate. The double-threaded stud 26 further comprises a second portion of threads 74, which are adapted for being threaded into both the aperture 52 of the large-diameter skirt member 22 and the nut 28. The large distance of the arms 33 from a center portion of the large-diameter skirt member 22 facilitates the application of high-torque forces onto the large-diameter skirt member 22 and, subsequently, onto the double-threaded stud 26.

Figure 5:
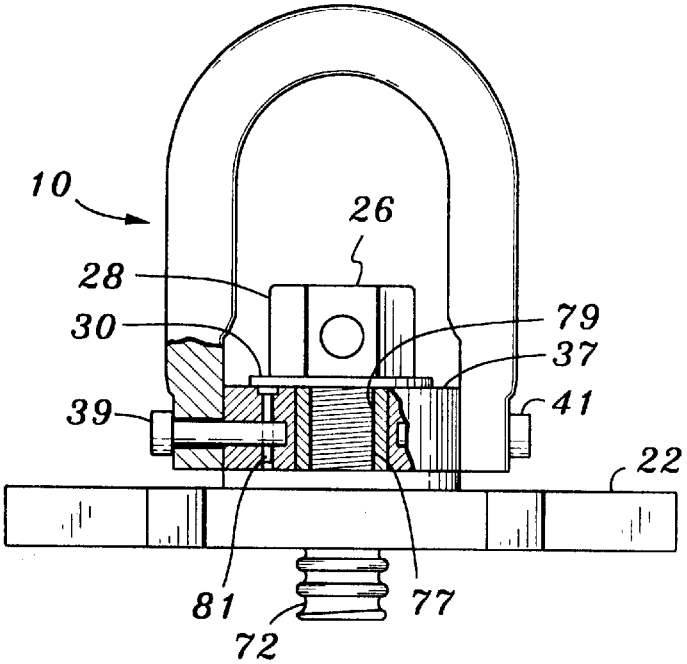
FIG. 5 illustrates a partial cross-sectional view of a trench plate connector in accordance with the present invention.

FIG. 5 illustrates a partial cross-sectional view of the trench plate connector 10 of the present invention. Mounted on the double-threaded stud 26 is a bushing 77, the bushing 77 having an axial bore 79 for receiving the double-threaded stud 26. The bushing 77 is rotatable about the double-threaded stud 26, and the load ring 37 is rotatable about both the bushing 77 and the double-threaded stud 26. The load ring 37 frictionally engages and is seated on a raised portion of the large-diameter skirt member 22. The load ring 37 can be freely rotated in either direction for a full 360 degrees about an axis of the double-threaded stud 26. The circular plate 30 is fitted over the double-threaded stud 26 and is located between the nut 28, on one side and the surfaces of the load ring 37 and the bushing 77 on the other side.

Each of the pivot pins 39,41 is attached to the load ring 37 by a corresponding lock pin 81, for example, fitted into a vertical bore formed through the load ring 37 and extending through a compatible and aligned hole formed in the end of the pin 39, for example. The ends of the vertical bore containing the lock pin 81, for example, are closed by the circular plate 30 and the surface of the large-diameter skirt member 22 so as to hold the lock pin 81, for example, in place and preclude unintentional loss or disengagement.

The present invention relates generally to load carrying connectors, such as the above-described swivel hoist rings, and also eye bolts and lifting plates. These connecting devices are often manufactured to lift extremely heavy components, wherein failure of such a lifting device can be catastrophic. The present invention relates to stamping unique serial numbers on each connector, wherein each serial number provides a complete history of the individual connector. The serial number is preferably permanently stamped, embedded, or molded into the carrying connector. Information encoded in each serial number preferably includes the particular manufacturer of the component, as well as the particular site and date of manufacture. Other information encoded in the serial number includes information on the load testing of the component and certification thereof; information on the material testing of the components, including the history of the material and the source of the raw material, for example; the site of heat treatment of the lifting components and the particular test results of the particular component, and the certification thereof; the magnetic-particle inspection testing data, including test results and certification thereof, and further including the particular site and date of such tests.

Additional information may relate to the finishing of a lifting component and dates of all of the above processes. Any single one or more of the above processes may be included into the serial number, although in the presently preferred embodiment all of the above information relating to structural integrity of the lifting component is encoded. The encoding of this information and placement on each lifting component provides a history and helps to assign responsibility to any potential failure of a lifting component. Failures of lifting components can be traced to particular sources, including either the manufacturer, the ultimate user of the lifting component, or a combination of both.

A hoist ring having a large diameter skirt integrally formed with a load ring, and also having a unique serial number permanently affixed thereto, is disclosed. In one embodiment, the structure of the hoist ring can be similar to the structure disclosed in co-pending U.S. application Ser. No. 09/108,573, which is commonly assigned and the contents of which are expressly incorporated herein by reference.

The serial number may be machine readable. In one embodiment, the serial number is automatically and periodically monitored by a code reading apparatus, to ensure that the proper hoist ring is affixed to the proper device to be lifted. In another embodiment, a user can carry a code reader and periodically read the code to ensure that the carrying device has a proper serial number. For example, if a carrying device has been recalled, the code reader will index the read serial number with the serial number in a look up table within the code reader, and an alarm will sound indicating that the hoist ring should not be used.

In accordance with another aspect of the present invention, a code reader is activated by a user to read a permanently attached serial number on the hoist ring. The code reader then displays specifications on a display of the code reader, so that the user can compare the specifications to the intended application and determine whether the carrying device is properly matched to the application at hand. In accordance with yet aspect of the present invention, a user is prompted to enter specifications for an intended use, such as the weight of the device to be lifted. Subsequently, the code reader is activated by the user to read the permanently attached serial number on the hoist ring. The code reader then provides a visual and/or audible indication as to whether the selected carrying device is a proper fit with the intended application.

Although an exemplary embodiment of the invention has been shown and described, many other changes, modifications and substitutions, in addition to those set forth in the above paragraphs, may be made by one having ordinary skill in the art without necessarily departing from the spirit and scope of this invention.

What is claimed is:

1. A trench plate connector, comprising:

a double threaded stud having a proximal end, a distal end, and a rotational axis extending therebetween, the double-treaded stud comprising a nut at the proximal end, and further comprising a first thread near the proximal end and a second thread near the distal end, the first thread being different in dimension than the second thread;

a load ring disposed around a portion of the double-threaded stud between the proximal end and the distal end;

an eye member coupled to the load ring, a skirt member coupled to the double-threaded stud around the first thread, the skirt member comprising a large diameter relative to a width of the eye member measured in a direction perpendicular to the rotational axis; and machine-readable encoded information permanently affixed to the trench plate connector.

2. The trench plate connector as recited in claim 1 the second thread having a greater pitch than the first thread.

3. The trench plate connector as recited in claim 1, the second thread being courser than the first thread.

4. The trench plate connector as recited in claim 1, the skirt member comprising at least one arm.

5. The trench plate connector as recited in claim 4, the a least one arm comprising a plurality of arms.

6. The trench plate connector as recited in claim 4, the eye member being coupled to the load ring via two pivot arms.

7. The trench plate connector as recited in claim 6, and further comprising a bushing disposed around the double-threaded stud between the double-threaded stud and the load ring, the eye member being coupled to the load ring via the two pivot pins which extend into the load ring.

8. The trench plate connector as recited in claim 7, wherein:

each of the two pivot pins is secured into the load ring via a lock pin;

the skirt member comprises an upper surface and a lower surface, the lower surface being adapted to contact a trench plate; and each lock pin comprises a first end and a second end, the first end of each lock pin being disposed near the upper surface of the skirt member.

9. The trench plate connector as recited in claim 8, and further comprising:

a circular plate disposed between the nut and the load ring;

wherein the second end of each lock pin is disposed near the circular plate.

10. A trench plate connector, comprising:

a stud having a proximal end, a distal end, and a rotational axis extending therebetween;

a load ring disposed around a portion of the stud between the proximal end and the distal end;

an eye member coupled to the load ring;

a large diameter skirt member coupled to the stud, the large diameter skirt member comprising a large diameter relative to a width of the eye member measured in a direction perpendicular to the rotational axis; and machine-readable encoded information permanently affixed to the trench plate connector.

11. The trench plate connector as recited in claim 10, wherein the stud comprises a double-threaded stud.

12. The trench plate connector as recited in claim 11, wherein the large-diameter skirt member comprising at least one radially extending arm, which extends radially from the rotational axis in a plane which is generally parallel with a plane of the large-diameter skirt member.

13. The trench plate connector as recited in claim 12, wherein:

the large-diameter skirt member has a maximum diameter measured in a first plane of the large-diameter skirt member and a minimum diameter measured in a second plane of the large-diameter skirt member; and the first plane is parallel to the second plane.

14. The trench plate connector as recited in claim 13, wherein a ratio of the minimum diameter to the maximum diameter is 0.95 or less.

15. The trench plate connector as recited in claim 13, wherein a ratio of the minimum diameter to the maximum diameter is about 0.8.

16. A trench plate connector, comprising:

a stud having a proximal end, a distal end, and a rotational axis extending, therebetween, a load ring disposed around a portion of the stud between the proximal end and the distal end, an eye member coupled to the load ring;

a skirt member coupled to the stud, the skirt member comprising at least one arm extending radially therefrom, and machine-readable encoded information permanently affixed to the trench plate connector.

17. The trench plate connector as recited in claim 16, wherein:

the a least one arm comprises a plurality of arms extending radially therefrom;

the stud has a stud diameter; and each arm of the plurality of arms extends from the skirt member a distance which is approximately equal to the stud diameter.

18. The trench plate connector as recited in claim 16, the a least one arm comprising a plurality of arms extending radially therefrom.

19. The trench plate connector as recited in claim 16, the stud comprising a double-threaded stud.

* * * * *